US006204833B1

(12) United States Patent
Hayashi et al.

(10) Patent No.: US 6,204,833 B1
(45) **Date of Patent: *Mar. 20, 2001**

(54) DISPLAY DEVICE

(75) Inventors: Masatake Hayashi; Tomoaki Kichimi, both of Kanagawa (JP)

(73) Assignee: Sony Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/522,918

(22) Filed: Sep. 1, 1995

(30) Foreign Application Priority Data

Sep. 2, 1994 (JP) ..... 6-234289
Apr. 28, 1995 (JP) ..... 7-129358

(51) Int. Cl.[7] ..... G09G 3/20
(52) U.S. Cl. ..... 345/58; 345/60; 345/63; 315/169.4
(58) Field of Search ..... 345/58, 60, 63; 315/169.4

(56) References Cited

U.S. PATENT DOCUMENTS 5,177,406 * 1/1993 Troxell ..... 315/169.1
5,349,454 * 9/1994 Iwama ..... 345/60
5,396,149 * 3/1995 Kwon ..... 345/72
5,434,454 * 7/1995 Park ..... 345/58
5,471,228 * 11/1995 Ilcisin ..... 345/60

FOREIGN PATENT DOCUMENTS 0 436 416 A1 9/1991 (EP) .
0 484 969 A2 5/1992 (EP) .
0 535 954 A2 4/1993 (EP) .
0 592 201 A1 4/1994 (EP) .

OTHER PUBLICATIONS

IBM Technical Disclosure Bulletin, vol. 36, No. 5, pp. 509–510, May 1993, "GAMMA Correction Control".

* cited by examiner

*Primary Examiner*—Steven J. Saras
*Assistant Examiner*—Amr Awad
(74) *Attorney, Agent, or Firm*—Sonnenschein, Nath & Rosenthal

(57) ABSTRACT

A display device comprising a display panel, a plasma driving circuit, a correcting circuit and a display driving circuit. The display panel has a laminated structure consisting of a display cell with signal electrodes arrayed in columns, a plasma cell with discharge channels arrayed in rows, and a dielectric sheet interposed therebetween. The plasma driving circuit sequentially drives the discharge channels to address the display cell line-sequentially via the dielectric sheet, and the correcting circuit processes picture signals through a corrective arithmetic operation. And the display driving circuit supplies the processed picture signals to the signal electrodes in synchronism with the line-sequential addressing, and then writes the picture signals in pixels prescribed at the intersections of the signal electrodes and the discharge channels. The correcting circuit executes such a process as to emphasize the difference between the picture signals supplied to mutually adjacent signal electrodes. This display device is adapted to eliminate, in driving the plasma addressed display panel, inter-pixel crosstalk or data diffusion derived from the thickness of the dielectric sheet.

15 Claims, 9 Drawing Sheets

DISPLAY DEVICE

BACKGROUND OF THE INVENTION

1. Field of the Invention

The present invention relates to a display device with a plasma addressed display panel where a display cell and a plasma cell are superimposed via a common dielectric sheet, and more particularly, the present invention relates for a configuration for a driving circuit for a plasma addressed display panel. Additionally the invention relates to a structure for suppressing crosstalk which is dependent on the thickness of a dielectric sheet interposed between the display cell and the plasma cell to separate them from each other.

2. Description of Related Art

There has been proposed a plasma addressed display panel where a plasma cell is utilized for addressing a display cell, and a typical one is disclosed in, e.g., Japanese Patent Laid-open No. Hei 1 (1989)-217396. As shown in FIG. 9, this plasma addressed display panel has a stacked structure consisting of a display cell 101, a plasma cell 102 and a common dielectric sheet 103 interposed therebetween. The plasma cell 102 is comprised of a glass substrate 104 and is joined to the dielectric sheet 103 with a predetermined space kept therebetwen. This space is sealed up with an ionizable gas contained therein. On the inner surface of the glass substrate 104, there are formed striped discharge electrodes 105 in the direction of rows. The striped discharge electrodes 105 function alternately as anodes and cathodes to generate plasma discharges 106 therebetween. Each pair of the anodes and cathodes constitute a discharge channel. Meanwhile the discharge cell 101 is comprised of a glass substrate 107. This glass substrate 107 is disposed opposite to the dielectric sheet 103 through a predetermined gap, which is filled with an electro-optical substance such as a liquid crystal 108. Striped signal electrodes 109 are formed on the inner surface of the glass substrate 107. The signal electrodes 109 extend in the direction of columns and intersect orthogonally with the row-direction discharge channels, wherein matrix pixels are located at the intersections of the signal electrodes and the discharge channels. In the plasma addressed display panel having such a structure, display driving is performed by line-sequentially switching and scanning the striped discharge channels where plasma discharges 106 are generated and simultaneously applying, in synchronism with the scanning, picture signals to the signal electrodes 109 on the side of the display cell 101. Upon generation of plasma discharges 106 in the discharge channels, the inside is turned to the anode potential substantially uniformly, and the pixels are selected per row. That is, each discharge channel functions as a sampling switch. When a picture signal is applied to each pixel in an conducting state of the sampling switch, the pixel can be turn on or off under control. And even after the sampling switch is turned to its non-conducting state, the picture signal is still held in the related pixel and thus a sample-and-hold action is performed.

The problems to be solved by the present invention will now be described below with reference to FIG. 9. In the plasma addressed display panel where a picture signal is written by utilizing a plasma discharge, there occurs crosstalk termed "data diffusion" in the direction orthogonal to the signal electrodes 109 (along the discharge channels) resulting from the thickness of the dielectric sheet 103 which separates the liquid crystal 108 and the discharge channel from each other. This crosstalk called, data diffusion, is caused by the interference between the data of adjacent pixels. This phenomenon results in poor color representation, and in a worse case, in degrading the horizontal resolution. For this reason, the color reproducibility is inferior in such a color display. Hereinafter an explanation will be given on a mechanism of causing such data diffusion. As shown in FIG. 9A, a plasma discharge 106 is generated at the time of writing a picture signal in each pixel, and after selection of the pixel, a picture signal supplied to the signal electrode 109 is written in a liquid crystal capacity. Subsequently, as shown in FIG. 9B, the plasma discharge is brought to a halt to induce a non-selected state, whereby the picture signal is held. First, when the picture signal is written, a charge pattern corresponding to the picture signal is formed on one side of the dielectric sheet 103 in contact with the plasma discharge 106. However, since the total thickness of the liquid crystal 108 and the dielectric sheet 103 is so large as to be nonnegligible in comparison with the pixel pitch, the charge pattern thus formed fails to be completely coincident with the shape of the pixel, and consequently the charge pattern is expanded with the data diffusion. During the picture signal holding period (almost the entire period of the actual operation time, e.g., 479/480), as shown in FIG. 9B, an electric field is selectively applied to the inside of the liquid crystal 108 by the charge pattern 110 formed on one side of the dielectric sheet 103 which is in contact with the plasma discharge, so that the liquid crystal 108 is driven. As the voltage level of the picture signal during this period is zero volts on average, the electric lines of force at this time are such as illustrated, so that an electric field, which is further expanded than the charge pattern formed at the time of writing the picture signal, is applied to the liquid crystal 108. Upon the occurrence of such data diffusion, color mixture is caused to induce deterioration of the color reproducibility as a result in case striped color filters are formed for example correspondingly to the striped signal electrodes. Further, there arises another serious problem that the resolution is lowered in a direction orthogonal to the striped signal electrodes.

SUMMARY OF THE INVENTION

It is therefore an object of the present invention to eliminate, in driving a plasma addressed display panel, such data diffusion derived from the thickness of a dielectric sheet as observed in the prior art.

According to one aspect of the present invention, there is provided a display device which fundamentally comprises a plasma addressed display panel, a plasma driving circuit and a display driving circuit. The plasma addressed display panel has a layered structure consisting of a display cell with signal electrodes arrayed in columns, a plasma cell with discharge channels arrayed in rows, and a common dielectric sheet interposed therebetween. The plasma driving circuit sequentially drives the discharge channels to thereby address the display cell line-sequentially via the dielectric sheet. Meanwhile the display driving circuit supplies picture signals to the signal electrodes in synchronism with the line-sequential addressing and writes the picture signals in the pixels prescribed at the intersections of the signal electrodes and the discharge channels, thereby displaying a picture. The display device further comprises, as another requisite thereof, a correcting circuit for previously processing the picture signals through a corrective arithmetic operation and then supplying the corrected picture signals to the display driving circuit, hence canceling the data diffusion or crosstalk caused between adjacent pixels due to the thickness of the dielectric sheet. For example, the correcting circuit performs a corrective arithmetic operation with regard to the picture signals supplied to three adjacent signal electrodes to which three primary colors are allocated respectively. In this case, prior to such corrective arithmetic operation, the correcting circuit matches the phases of the picture signals by executing a process of relative delay to the picture signals supplied to the three signal electrodes. Practically, it is preferred that the correcting circuit converts, in advance of the above corrective arithmetic operation, external input primary picture signals into secondary picture signals in accordance with the nonlinearity of the electro-optical characteristics of the display cell.

When necessary, the correcting circuit adaptively adjusts the picture-signal corrective arithmetic operation in accordance with the luminance or the color saturation of the displayed picture to thereby maintain constant the amplitude of the picture signals. In this case, a voltage generating circuit for supplying a predetermined reference voltage to the plasma driving circuit is included in the display device. The plasma driving circuit drives the plasma cell in response to such an inversion reference voltage and prescribes the potential of each discharge channel. And the correcting circuit controls the voltage generating circuit in accordance with adjustment of the aforementioned corrective arithmetic operation to thereby optimize the inversion reference voltage.

In the plasma addressed display panel, a picture signal is written in the liquid crystal cell by utilizing the plasma discharge of the plasma cell. At this time, some crosstalk known as data diffusion is induced by the interference between the adjacent signal electrodes due to the thickness of the dielectric sheet which separates the plasma cell and the display cell from each other. However, in the present invention, the inter-pixel crosstalk derived from the thickness of the dielectric sheet is canceled by first processing the picture signal through a corrective arithmetic operation by means of the correcting circuit and then supplying the corrected picture signal to the signal electrode via the display driving circuit. In other words, the display driving is performed by modulating the picture signal in a manner to emphasize the difference between the adjacent signal electrodes, hence correcting the data diffusion. As a result of such correction of the picture signal, the difference between the adjacent signal electrodes is emphasized to consequently increase the amplitude of the picture signal, whereby a load is imposed on the display driving circuit. For the purpose of reducing such a load, adaptive adjustment is performed, when necessary, on the basis of the luminance or the color saturation of the entire picture, hence suppressing the increase in the amplitude of the picture signal. In any display device employing a liquid crystal as an electro-optical material, the luminance of the displayed picture is not proportional to the voltage applied to the liquid crystal, due to the influence from the electro-optical characteristic (voltage-to-luminance characteristic) of the liquid crystal. On the other hand, the display device needs to be so contrived that the luminance is proportional to the primary picture signal input from an external source. It is therefore impossible to achieve complete elimination of the above-described crosstalk merely by direct execution of the corrective arithmetic operation to the primary picture signal (input signal). For this reason, it is preferred that the aforementioned corrective arithmetic operation be performed by comparison of the input signal with the data of the adjacent pixel after conversion of the input signal into a value (secondary picture signal) corresponding to the voltage applied to the liquid crystal.

The above and other features and advantages of the present invention will become apparent from the following description which will be given with reference to the illustrative accompanying drawings.

DESCRIPTION OF THE PREFERRED EMBODIMENTS

Figure 1:
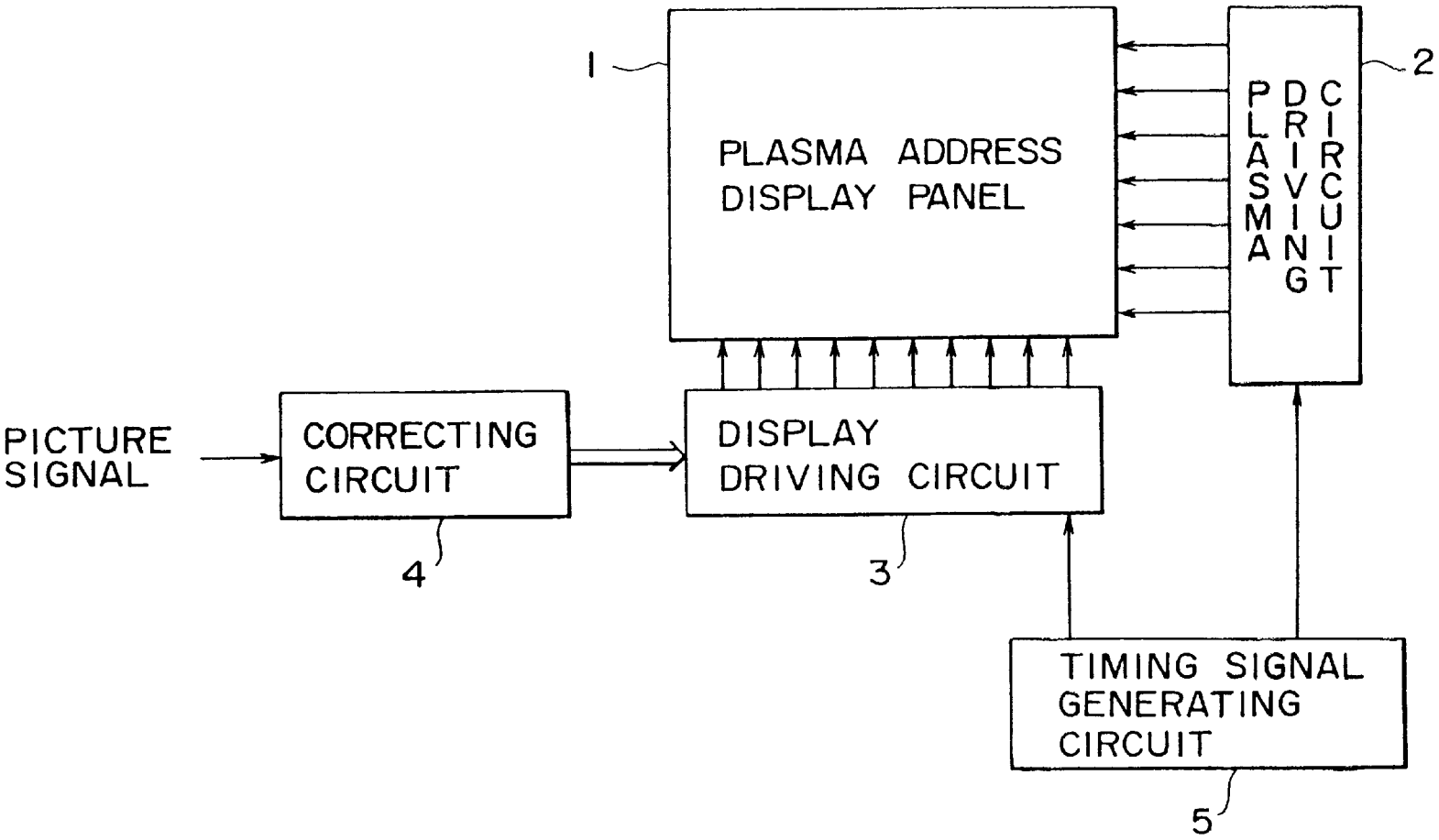
FIG. 1 is a block diagram of a first embodiment representing the display device of the present invention.

Hereinafter preferred embodiments of the present intention will be described in detail with reference to the accompanying drawings. FIG. 1 is a block diagram which illustrates the fundamental constitution of a display device according to the present invention. As shown in the diagram, this display device comprises a plasma addressed display panel 1, a plasma driving circuit 2 and a display driving circuit 3. The plasma addressed display panel 1 has a laminated structure comprising a display cell with signal electrodes arrayed in columns, a plasma cell with discharge channels arrayed in rows, and a common dielectric sheet interposed therebetween. The plasma driving circuit 2 sequentially drives the discharge channels to thereby address the display cell line-sequentially via the dielectric sheet. Meanwhile the display driving circuit 3 supplies picture signals to the signal electrodes in synchronism with the line-sequential addressing and writes the picture signals in pixels defined at the intersections of the signal electrodes and the discharge channels, thereby displaying a picture. The display device of the present invention further comprises, a correcting circuit 4 for processing the picture signals through a corrective arithmetic operation and then supplying the corrected picture signals to the display driving circuit, hence canceling the data diffusion or crosstalk caused between adjacent pixels due to the thickness of the dielectric sheet. In other words, the voltages of the picture signals are so modulated as to emphasise the difference between adjacent signal electrodes. For example, the correcting circuit 4 performs a corrective arithmetic operation with regard to the picture signals supplied to three mutually adjacent signal electrodes to which three primary colors are allocated respectively, thereby preventing mixture of colors to consequently maintain satisfactory color reproducibility. In addition, a timing signal generating circuit 5 is provided for synchronizing the plasma driving circuit 2 and the display driving circuit 3 with each other by supplying a predetermined timing signal to both the plasma driving circuit 2 and the display driving circuit 3.

Figure 2:
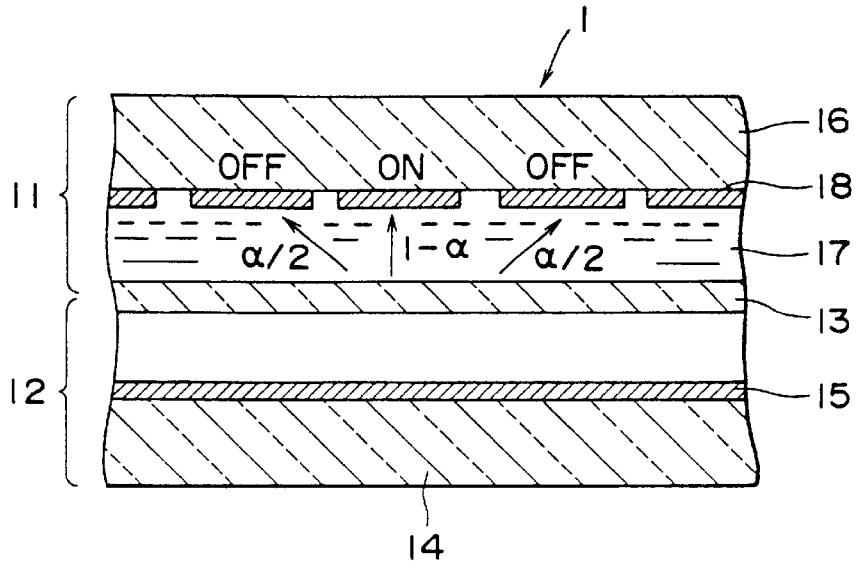
FIG. 2 is a typical partially sectional view showing the structure of a plasma addressed display panel included in the first embodiment.

FIG. 2 is a typical partial sectional view showing a specific structure of the plasma addressed display panel 1 included in FIG. 1. As illustrated, the plasma addressed display panel 1 has a laminated flat panel structure where a display cell 11 and a plasma cell 12 are superimposed via a dielectric sheet 13. The plasma cell 12 is comprised of a lower glass substrate 14 and is joined to the dielectric sheet 13 with a predetermined space kept therebetween. This space is sealed with an ionizable gas contained therein. On the inner surface of the glass substrate 14, striped discharge electrodes 15 are formed in the direction of rows. The discharge electrodes 15 alternately function as anodes and cathodes to constitute discharge channels, so that plasma discharge is generated therebetween. The display cell 11 is comprised of an upper glass substrate 16. This glass substrate 16 is disposed opposite to the dielectric sheet 13 via a predetermined gap, which is filled with an electro-optical substance such as a liquid crystal 17. On the inner surface of the glass substrate 16, striped signal electrodes 18 are formed in the direction of columns. These signal electrodes 18 intersect orthogonally with the rows of discharge channels, and matrix pixels are prescribed at the intersections thereof.

As described, in any plasma addressed display panel having the above structure, data diffusion is caused by crosstalk or interference which is induced between adjacent pixels in the direction of the discharge channels due to the thickness of the dielectric sheet 13. Such data diffusion is denoted by a parameter $\alpha$. This parameter $\alpha$ represents the rate of the electric lines of force flowing into two adjacent pixels. The parameter $\alpha$ takes a value greater than 0 but smaller than $2/3$ and ranges from 0.2 to 0.3 or so for example. Suppose now that, as an exemplary case, striped color filters of three primary colors R (red), G (green) and B (blue) are laminated correspondingly to each of the signal electrodes 18 to perform color display. In comparison with picture signal voltages (Ri, Gi, Bi) of three primary colors R, G, B applied to the signal electrodes 18, effective voltages (Ro, Go, Bo) for practically driving the liquid crystal can be expressed approximately by the following equation.

$$\begin{matrix} Ro \\ Go \\ Bo \end{matrix} = \begin{matrix} 1-\alpha & \alpha/2 & \alpha/2 \\ \alpha/2 & 1-\alpha & \alpha/2 \\ \alpha/2 & \alpha/2 & 1-\alpha \end{matrix} \begin{matrix} Ri \\ Gi \\ Bi \end{matrix} \tag{1}$$

Here, $D(\alpha)$ is defined as:

$$\begin{matrix} 1-\alpha & \alpha/2 & \alpha/2 \\ \alpha/2 & 1-\alpha & \alpha/2 \\ \alpha/2 & \alpha/2 & 1-\alpha \end{matrix} = D(\alpha) \tag{2}$$

Generally an inverse matrix D-1 ($\alpha$) relative to the above matrix $D(\alpha)$ is existent (where $\alpha \neq 2/3$), and it is expressed by the following equation.

$$D^{-1}(\alpha) = \frac{1}{1-\frac{3}{2}\cdot\alpha} \begin{matrix} 1-\alpha/2 & -\alpha/2 & -\alpha/2 \\ -\alpha/2 & 1-\alpha/2 & -\alpha/2 \\ -\alpha/2 & -\alpha/2 & 1-\alpha/2 \end{matrix} \tag{3}$$

Picture signal voltages (Rd, Gd, Bd) to be properly written in the pixels are converted into corrected voltages (Ri, Gi, Bi) respectively in the following manner, and such corrected voltages are applied to the signal electrodes 18. More specifically, the correcting circuit 4 shown in FIG. 1 executes the following conversion of the original picture signal voltages (Rd, Gd, Bd) to thereby produce corrected picture signal voltages (Ri, Gi, Bi) and then inputs the same to the display driving circuit 3.

$$\begin{matrix} Ri \\ Gi \\ Bi \end{matrix} = D^{-1}(\alpha) \begin{matrix} Rd \\ Gd \\ Bd \end{matrix} \tag{4}$$

Consequently the effective voltages (Ro, Go, Bo) for practically driving the liquid crystal are expressed by the following equation and are therefore rendered coincident with the voltages (Rd, Gd, Bd), whereby proper picture signal voltages can be written as a result.

$$\begin{matrix} Ro \\ Go \\ Bo \end{matrix} = D(\alpha)\cdot D^{-1}(\alpha) \begin{matrix} Rd \\ Gd \\ Bd \end{matrix} = \begin{matrix} Rd \\ Gd \\ Bd \end{matrix} \tag{5}$$

The correcting circuit 4 first performs a corrective operation for the original picture signals on the basis of the above-described conversion and then supplies the corrected voltages to the display driving circuit 3, thereby eliminating the crosstalk or data diffusion caused between adjacent pixels due to the thickness of the dielectric sheet 13. Such corrective arithmetic operation may be performed by either a digital process using a DSP or an analog process using an analog matrix.

Although a description has been given in this embodiment with regard to an exemplary case of color display employing striped color filters of three primary colors, it is generally possible to achieve the same intended purpose not only by the above operation but also by executing another corrective arithmetic operation which emphasizes the difference between the picture signal applied to any one signal electrode 18 and the picture signal applied to an adjacent signal electrode, and then applying the corrected picture signal voltages. Thus, it is possible to apply proper voltages to the liquid crystal by supplying the corrected picture signals where the data diffusion is previously estimated as mentioned, hence realizing retention of satisfactory color reproducibility and resolution.

Figure 3A:
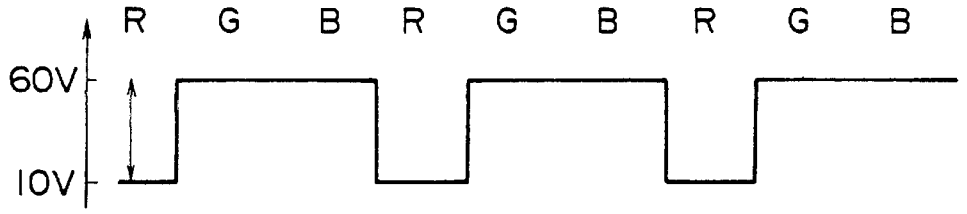
FIGS. 3A and 3B are waveform charts for explaining the operation of the first embodiment.
Figure 3B:
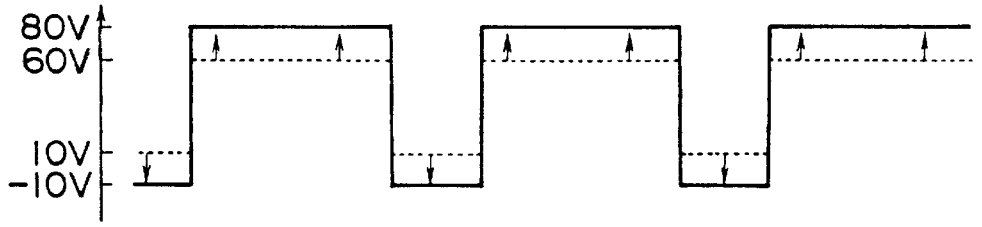

Hereinafter an exemplary process of the picture-signal corrective arithmetic operation will be described with reference to FIGS. 3A and 3B. This example represents a case of displaying a red picture in color display of a normally white mode. FIG. 3A shows the levels of picture signals when the corrective arithmetic operation is not performed, wherein a voltage of 10 V is applied to each of signal electrodes to which R (red) is allocated, while a voltage of 60 V is applied to each of signal electrodes to which G (green) and B (blue) are allocated. In the normally white mode, a red image is displayed since the luminance becomes higher in accordance with reduction of the voltage. In contrast therewith, FIG. 3B shows the voltages of picture signals obtained through the corrective arithmetic operation. As mentioned, the process of such corrective arithmetic operation is executed by modulating the voltage level in such a manner as to emphasize the difference between mutually adjacent signal electrodes, so that a voltage of −10 V is applied to each of the signal electrodes to which R (red) is allocated for example, while a voltage of 80 V is applied to each of the signal electrodes to which G (green) and B (blue) are allocated. Thus, the amplitude of the picture signal is increased by execution of the corrective arithmetic operation.

According to the first embodiment described above, the written data diffusion derived from the crosstalk peculiar to the plasma addressed display panel can be improved by modulating (correcting) the picture signals in such a manner as to emphasize the difference between mutually adjacent signal electrodes. However, there may arise some following disadvantages if a simple process of such corrective arithmetic operation is executed. Firstly, since the corrective arithmetic operation is performed in the direction to emphasize the difference, it is necessary to increase the output amplitude of the display driving circuit connected to each signal electrode. Therefore, semiconductors and so forth employed therein need to have higher dielectric strength. And secondly, because of the emphasis of the difference, the crosstalk caused by a lateral electric field between the other electrodes is increased on the contrary in the plasma addressed display panel. The above disadvantages may bring about increase of the power consumption, rise of the production cost of the driving circuit and further deterioration of the picture quality.

Figure 4:
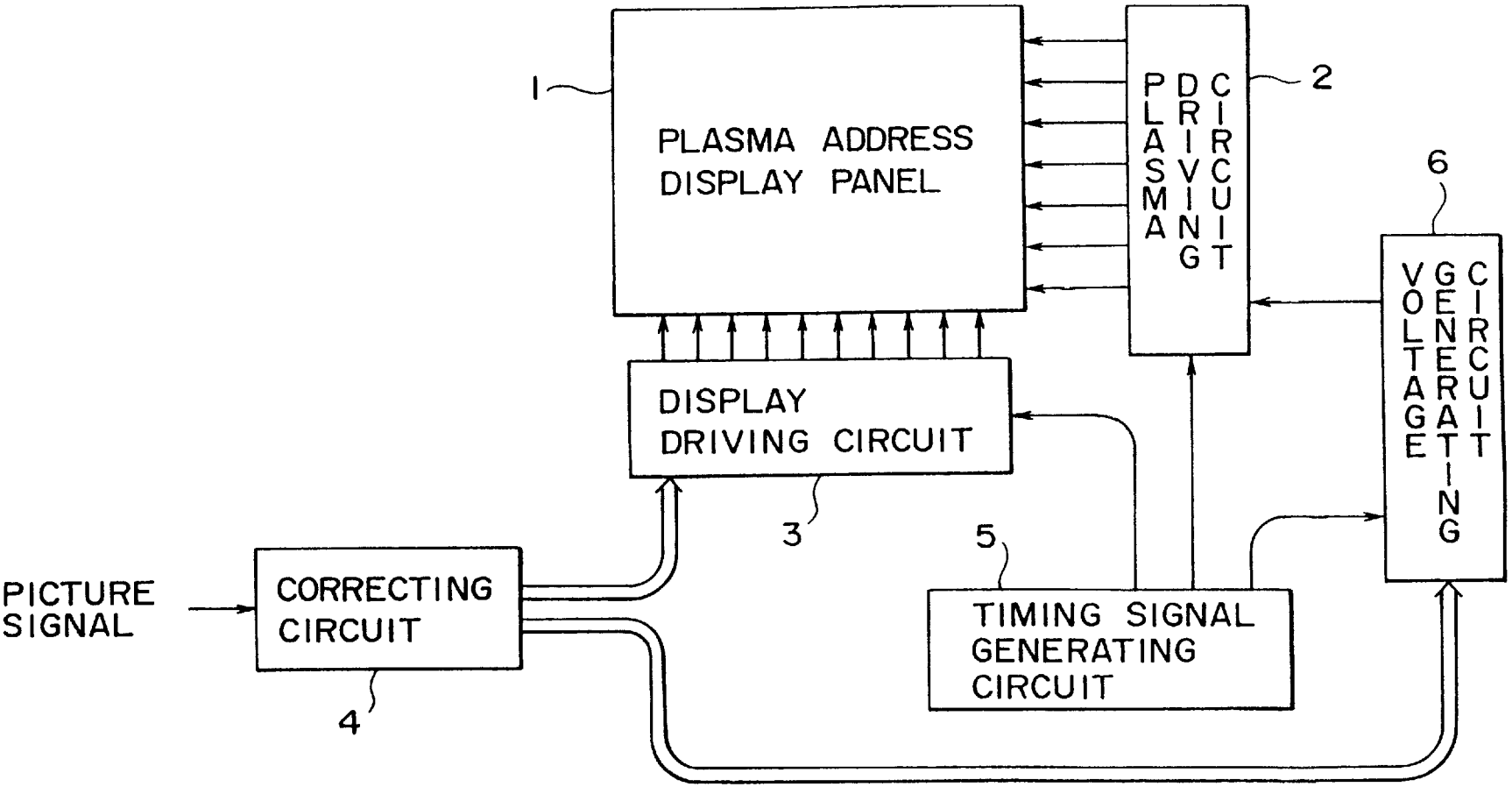
FIG. 4 is a block diagram of a second embodiment representing the display device of the present invention.
Figure 5:
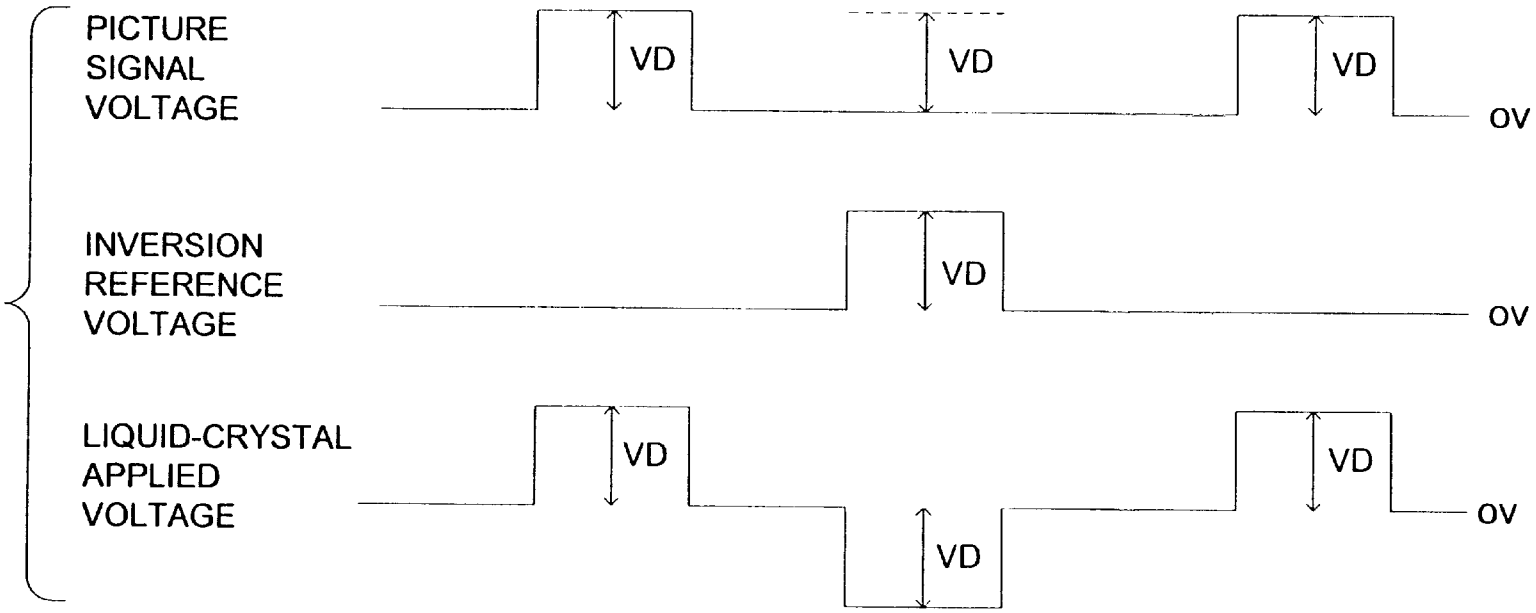
FIG. 5 is a timing chart for explaining the operation of the first embodiment.

Now a second embodiment contrived for eliminating such disadvantages will be described below with reference to FIG. 4. The fundamental structure of this embodiment is the same as that of the first embodiment shown in FIG. 1, and any like components corresponding to the aforementioned ones are denoted by like reference numerals to facilitate the understanding thereof. The second embodiment also has a correcting circuit 4 similarly to the first embodiment, wherein picture signals are previously processed through a corrective arithmetic operation and then are supplied to a display driving circuit 3 to thereby cancel the crosstalk caused between adjacent pixels due to the thickness of a dielectric sheet. As a characteristic, the correcting circuit 4 adaptively adjusts the picture-signal corrective arithmetic operation in accordance with the luminance or the color saturation of the displayed picture to thereby maintain constant the amplitude of the picture signal. Although not explained with regard to the first embodiment, the display device of the present invention further comprises a voltage generating circuit 6 to supply a predetermined inversion reference voltage to the plasma driving circuit 2. In response to the inversion reference voltage, the plasma driving circuit 2 drives the plasma cell to regulate the potential of each discharge channel. At this time, the correcting circuit 4 controls the voltage generating circuit 6 in accordance with adjustment of the corrective arithmetic operation to thereby optimize the inversion reference voltage.

Hereinafter the operation of the second embodiment shown in FIG. 4 will be described in detail with reference to FIGS. 5 through 8. First, for the purpose of clarity, the operation of the foregoing embodiment will be explained briefly with reference to a waveform chart of FIG. 5. In executing a simple process of the corrective arithmetic operation, the voltage applied to the liquid crystal is the difference between the picture signal voltage VD output from the display driving circuit 3 and the inversion reference voltage output from the voltage generating circuit 6 for changing the entire potentials in the plasma driving circuit 2. As shown, the liquid-crystal applied voltage VD is inverted in polarity every field to drive the liquid crystal in an alternating manner. In this case, it is obvious that the output withstand voltage of the display driving circuit 3 needs to be greater than at least the maximum-minus-minimum value of the voltage to be applied to the liquid crystal (i.e., liquid-crystal applied voltage).

Figure 6:
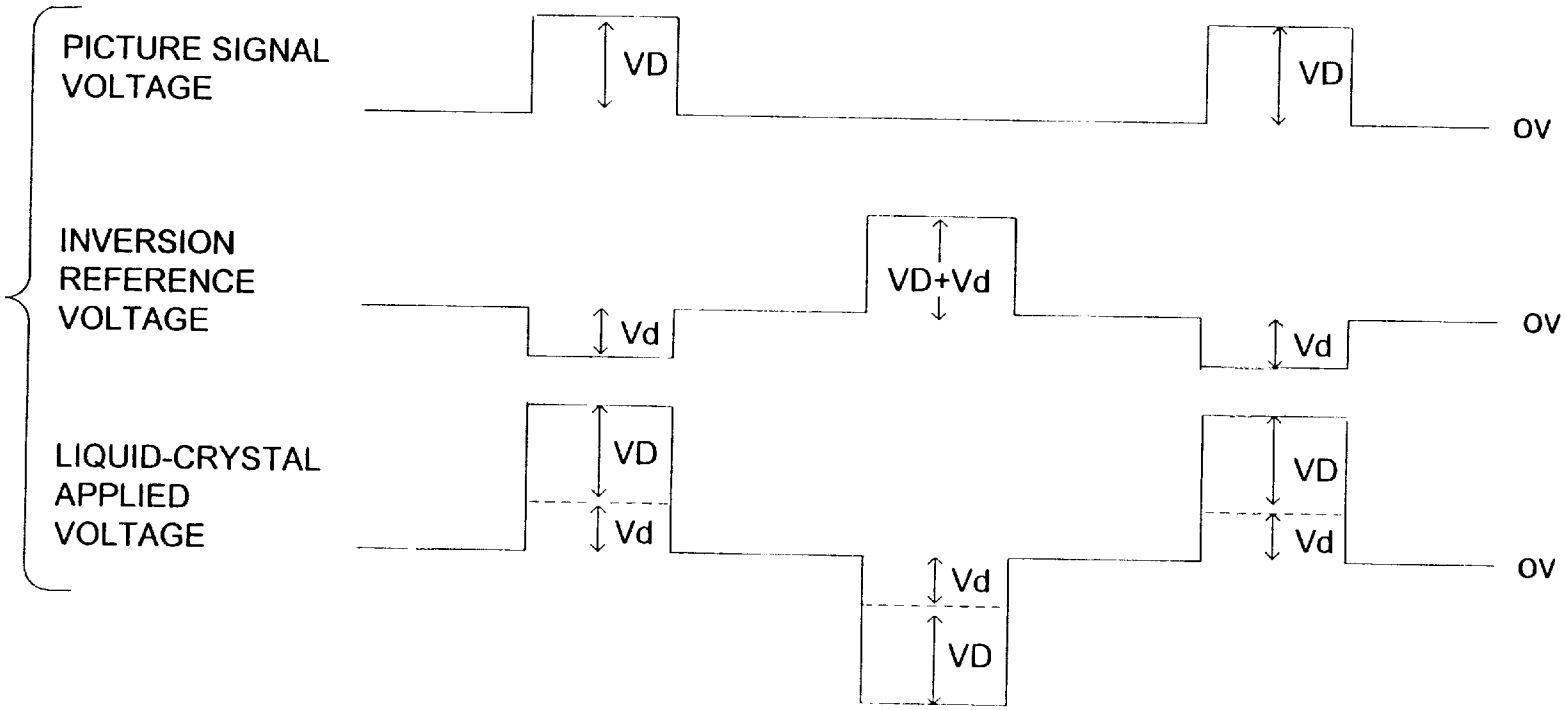
FIG. 6 is a timing chart for explaining the operation of the second embodiment.

FIG. 6 is a waveform chart for explaining the operation of the second embodiment. For example, an inversion reference voltage having an offset component Vd is output from the voltage generating circuit 6. Consequently, with respect to the absolute value of the liquid-crystal applied voltage, it is settable to be higher than the output amplitude of the display driving circuit 3 by a value corresponding to the offset component Vd. In this case, although the output amplitude of the voltage generating circuit 6 is required to be greater, numerically the output of this circuit is only one, and a desired circuit configuration is realizable with more facility than in another case of increasing the output withstand voltage of the display driving circuit 3 where an output of, e.g., 640×3 is required, hence ensuring a remarkable advantage with regard to the production cost as well. However, since the output of the voltage generating circuit 6 is supplied to the whole plasma addressed display panel 1, the maximum-minus-minimum value of the liquid-crystal applied voltage never exceeds, on any one discharge channel as described, the output withstand voltage of the display driving circuit 3.

When a correction for emphasizing the voltage difference between mutually adjacent signal electrodes is simply executed as a countermeasure to diminish the writing crosstalk or data diffusion peculiar to the plasma addressed display panel, the range of the liquid-crystal applied voltage naturally extends, so that the output withstand voltage of the display driving circuit 3 may be rendered insufficient. In general, when there is displayed a bright picture in vivid color as a whole (e.g., in a primary color of green), the practical chromaticity is substantially not affected even if red and blue pixels have a contrast of 20:1 or so which is lower than 100:1 in black-and-white display. The result is similar also when any dark area is existent in a portion of a bright picture. In view of the above, the second embodiment is contrived for first detecting the luminance or the color saturation from the entire picture to be displayed, then adaptively adjusting the picture-signal corrective arithmetic operation in accordance with the result of such detection, and reducing the output amplitude of the display driving circuit 3 while maintaining a satisfactory picture quality. That is, as shown in FIG. 4, the correcting circuit 4 performs not only corrective modulation of the picture signals supplied to the display driving circuit 3, but also control of the output amplitude of the voltage generating circuit 6 simultaneously with the corrective modulation.

Now the behavior of the writing crosstalk will be surveyed below. In a case of primary color display for example, even if the liquid-crystal applied voltage is set to 0V as graphically shown in FIG. 7, the effective voltage is somewhat left due to the crosstalk, so that it becomes necessary to drive the liquid crystal in the negative direction. And consequently, the required output amplitude VSO of the display driving circuit 3 is increased. In view of this point, the second embodiment is so contrived as to change the amplitude stepwise between two modes, such as a mode A and a mode B as shown, in conformity with the luminance or the color saturation of the entire picture. Since the picture signals output simultaneously are always included within fixed amplitudes of VSA and VSB, the output withstand voltage of the display driving circuit 3 need not be high. Meanwhile a transition from the mode A to the mode B is executed by simultaneously changing the output voltage of the voltage generating circuit 6 and that of the display driving circuit 3, so that in any intermediate step, a constant voltage is always applied to the liquid crystal.

Figure 7:
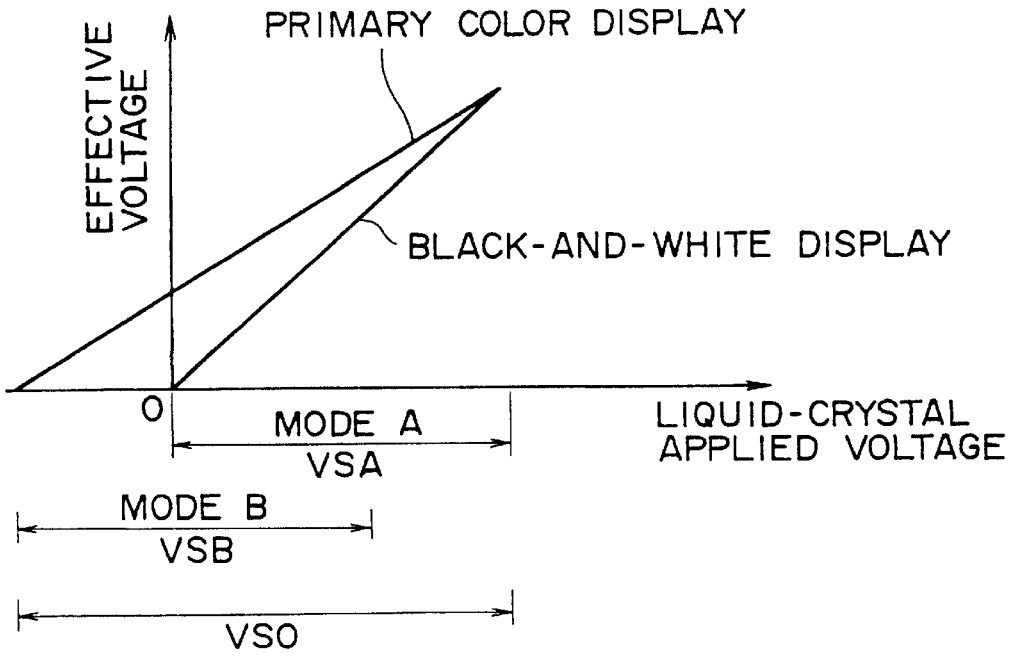
FIG. 7 graphically shows the relationship between the liquid-crystal applied voltage and the effective voltage in the second embodiment.
Figure 8A:
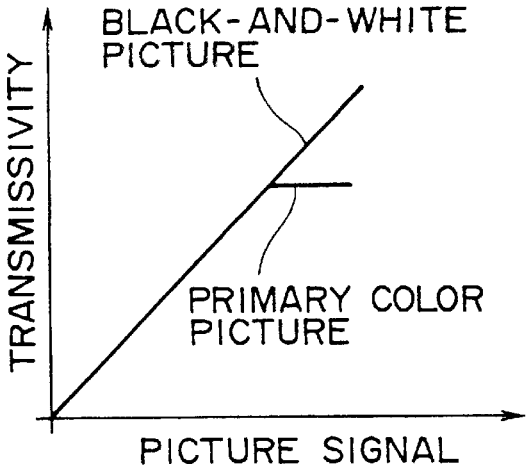
FIGS. 8A and 8B graphically show the relationship between the picture signal and the transmissivity in the second embodiment.
Figure 8B:
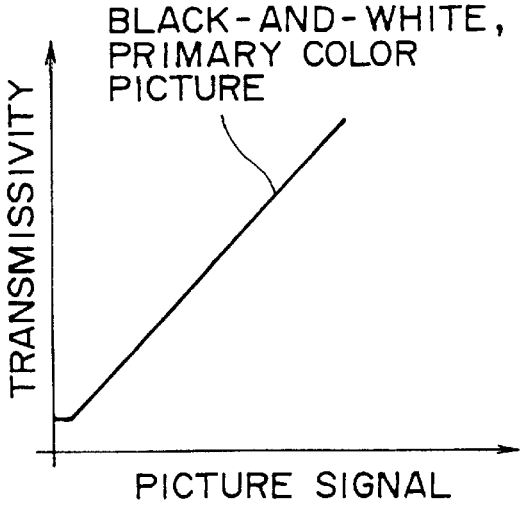
Figure 9A:
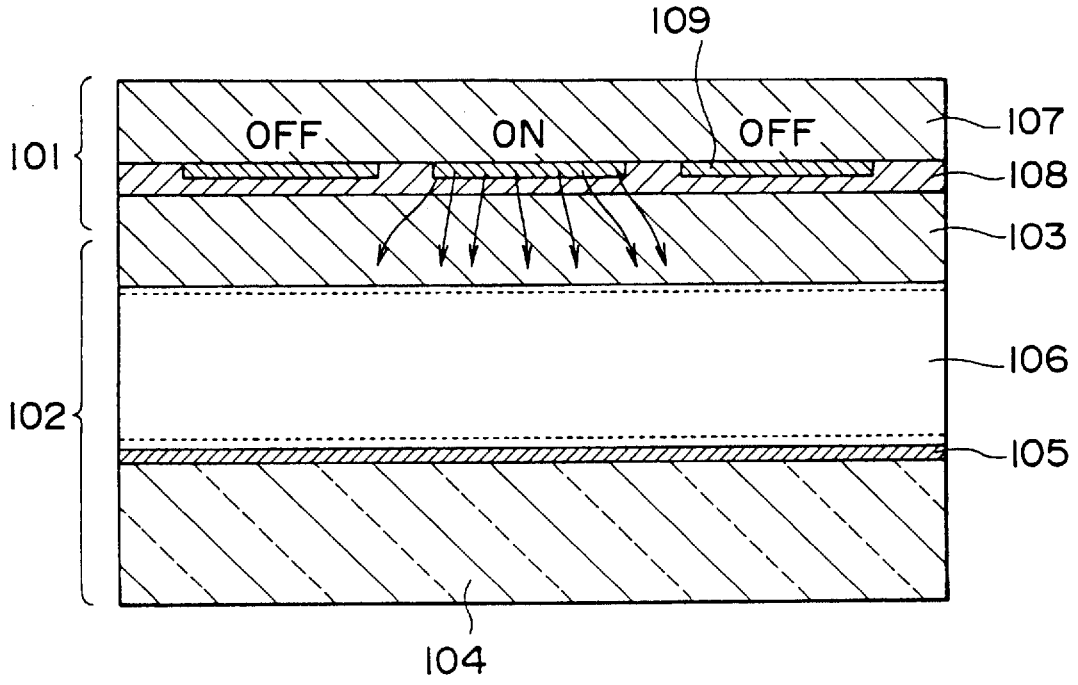
FIGS. 9A and 9B are typical sectional views showing an exemplary conventional plasma addressed display panel of the prior art.
Figure 9B:
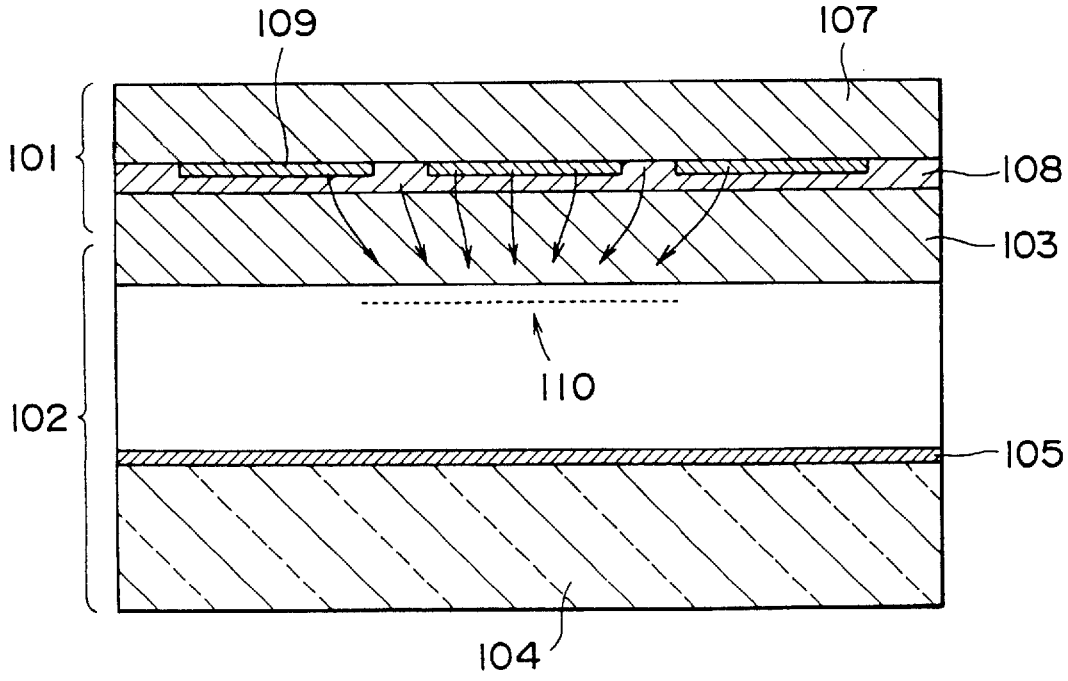

FIGS. 8A and 8B typically show the relationship between the input picture signal and the transmissivity of the display panel in the above case. Since this example relates to a normally white mode, the transmissivity plotted along the ordinate in the graphs of FIGS. 8A and 8B and the effective voltage plotted along the ordinate in the graph of FIG. 7 are mutually in a reverse relationship. The mode B shown in FIG. 8B is suited for an entirely bright picture with high color saturation, wherein both a black-and-white picture and a primary-color picture are reproducible satisfactorily on the high luminance side though being somewhat inferior in contrast. Meanwhile the mode A shown in FIG. 8A is suited for a case contrary to the mode B, wherein the contrast is superior but the reproducibility of a primary-color picture is slightly inferior on the high luminance side. Therefore, if a transition between the two modes is effected stepwise under control in accordance with the luminance or color saturation of an entire picture, satisfactory display is always rendered possible visually with a small output amplitude of the display driving circuit. Consequently the required output withstand voltage of the display driving circuit can be diminished, and further it becomes possible to decrease the power consumption and to suppress the potential difference between the signal electrodes, hence achieving reduction of the crosstalk caused by the lateral electric field of the inter-electrode liquid crystal. As a result, both enhancement of picture quality and reduction of the production cost can be achieved.

In the plasma addressed display panel, as described, a picture signal voltage is applied to the liquid crystal via the intermediate dielectric sheet because of its structure. Due to the existence of this dielectric sheet, the applied voltage is extended laterally to influence even the adjacent pixel to consequently cause crosstalk. This harmful influence becomes more conspicuous with an increase of the potential difference between the mutually adjacent pixels and is exerted in the direction to negate the voltage difference, thereby inducing deterioration of the color purity and the luminance. In the present invention, therefore, the amount of the voltage that may be negated as mentioned is previously estimated, and a correction of the picture signal voltage is performed in a manner to emphasize the voltage difference between the adjacent pixels. The crosstalk to be corrected in the present invention is dependent on the potential difference between mutually adjacent signal electrodes. However, when a crystal liquid is employed as an electro-optical material, generally a primary picture signal (input data) input from an external source and a voltage (secondary picture signal) applied to the crystal liquid are not proportional to each other. That is, the electro-optical characteristic of the liquid crystal indicates nonlinearity between the luminance and the applied voltage. Due to such nonlinearity, there may occur an improper case where an error is induced if the input data is processed directly through a corrective arithmetic operation. Therefore a proper result is attainable by once converting the input data into the voltage to be applied to the liquid crystal and, after performing a corrective arithmetic operation to eliminate crosstalk, converting the processed data into a required format adequate for the display driving circuit.

Figure 10:
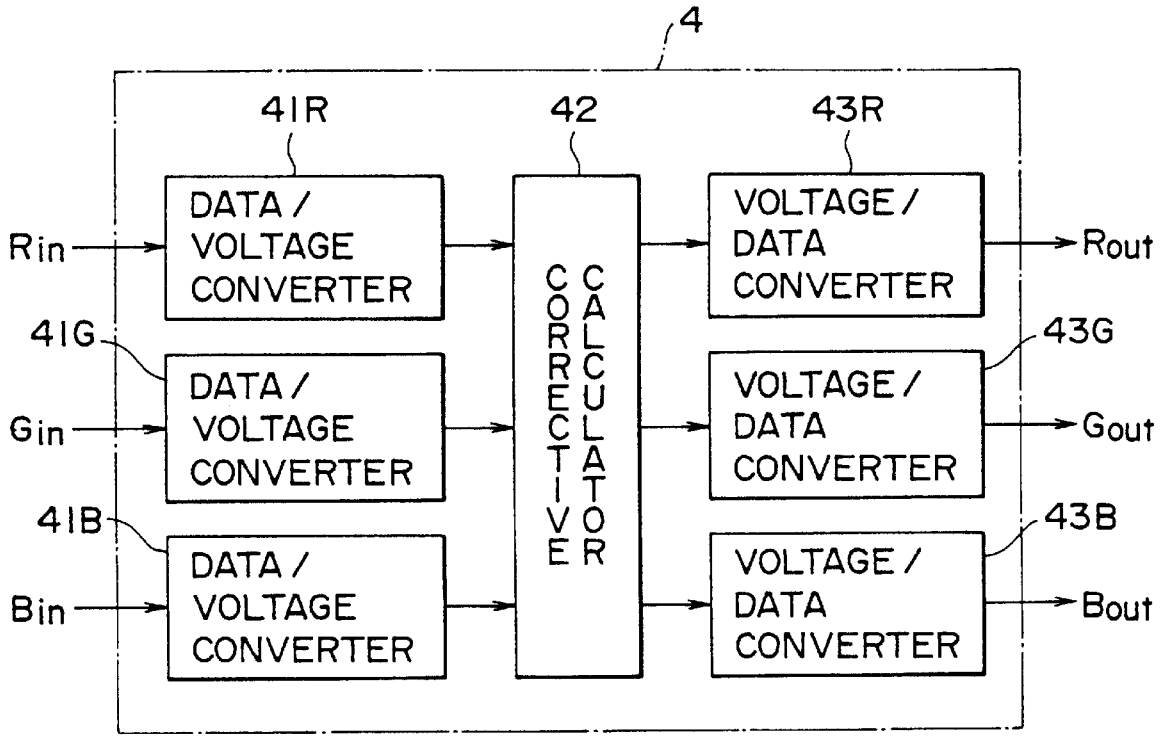
FIG. 10 is a block diagram of a correcting circuit which constitutes a principal portion of a third embodiment representing the display device of the present invention.

FIG. 10 shows a third embodiment contrived for the purpose of meeting the above requirement. A correcting circuit 4 employed in the third embodiment includes data/voltage converters 41R, 41G, 41B for converting three-system input data Rin, Gin, Bin into a corresponding voltage respectively. The circuit 4 also includes a corrective calculator 42 for practically executing a corrective arithmetic operation with respect to each of the voltages output from the data/voltage converters 41R, 41G, 41B. The circuit 4 further includes voltage/data converters 43R, 43G, 43B for reconverting the corrected values and producing three-system output picture signals Rout, Gout, Bout respectively. Thus, in the correcting circuit 4, the data/voltage converter 41 in the input stage and the voltage/data converter 43 in the output stage are divided respectively into three channels in conformity with the three systems (R, G, B), whereas the corrective calculator 42 is provided in common to each channel. Regarding the data/voltage converters 41R, 41G, 41B in the input stage, the number of input data are numerically finite in the case of a digital system, so that desired data/voltage conversion can be realized by storing the entire pattern of the input data as table data in a memory such as ROM or RAM and thereafter referring to the memory in response to each signal input. Such conversion is also realizable by another method that executes a calculation in response to each signal input by using a digital signal processor (DSP) or an operational amplifier.

The corrective calculator 42 is further divided into to two parts. One is a delay circuit for adjusting the timing of each input signal, and the other is a part for practically executing a corrective arithmetic operation of crosstalk. Each of the voltage/data converters 43R, 43G, 43B in the output stage converts the voltage into data of a predetermined output form dependent on the final display driving circuit 3 (FIG. 1). More specifically, relative to an analog-input display driving circuit, data is outputted after an adequate process such as digital-to-analog conversion, whereas relative to a digital-input display driving circuit, data is outputted after being compressed through analog-to-digital conversion. Otherwise the output gradation is rendered useless because the number of output data is extremely great as it is raised to the nth power of $2^3$ in the case of n bits. Such compression can be performed by means of a memory as well. Structurally, the component elements of the three blocks described above are substantially the same. Therefore, the configuration may be implemented by disposing the delay circuit in the first stage and grouping the remaining three blocks into one for batch processing to be executed by means of a memory or a digital signal processor.

Figure 11:
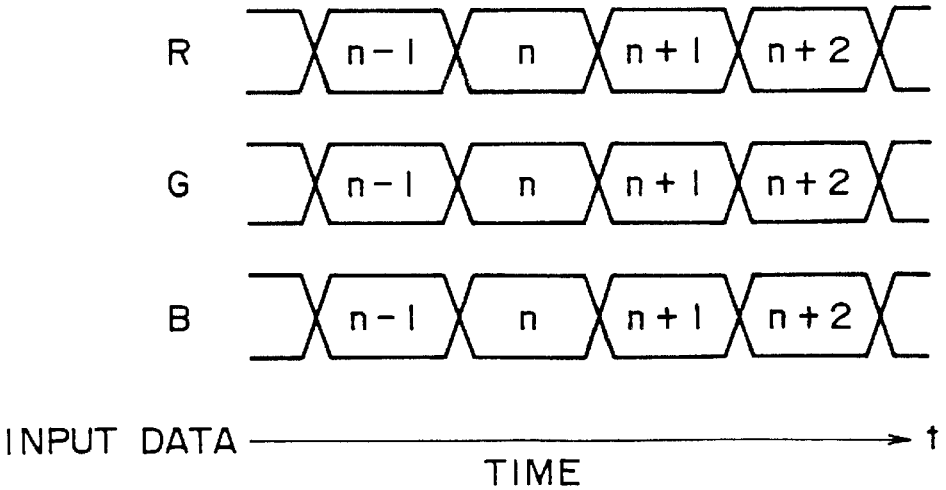
FIG. 11 is a timing chart for explaining the operation of the third embodiment.
Figure 12:
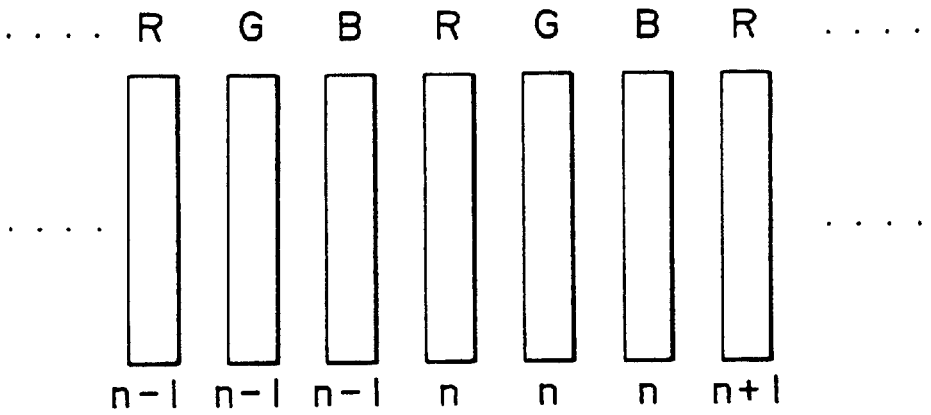
FIG. 12 shows an array of signal electrodes for explaining the operation of the third embodiment.
Figure 13:
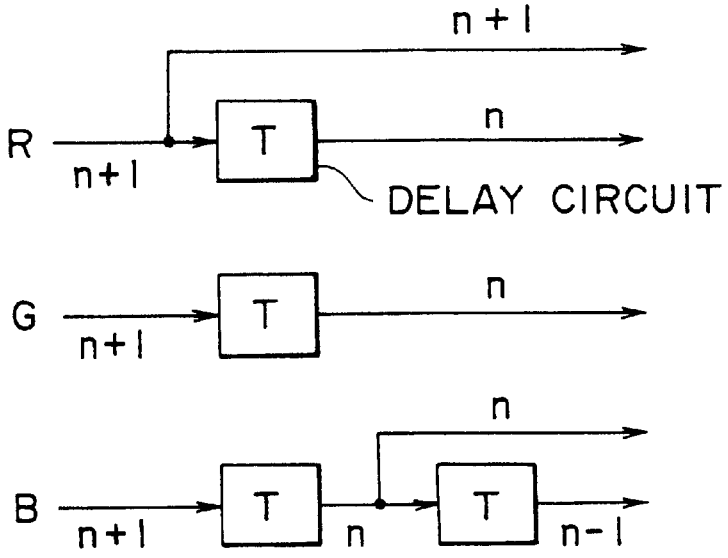
FIG. 13 is a block diagram of an exemplary delay circuit incorporated in the correcting circuit of the third embodiment.

Referring next to FIGS. 11 through 13, an explanation will be given on the delay circuit for adjusting the timing of the input signals in the corrective calculator 42. In general, as shown in FIG. 11, the data of three systems (R, G, B) are input simultaneously. In case the display panel has striped signal electrodes as illustrated in FIG. 12, a red (R) signal requires, for comparison with adjacent signals, three sets of data which consist of Bn−1 (=n−1th data of blue (B) signal; this expression will be applied to the following description as well), Rn and Gn. Meanwhile, a green (G) signal requires three sets of data consisting of Rn, Gn and Bn. And a blue (B) signal requires three sets of data consisting of Gn, Bn and Rn+1. Thus, for executing a corrective arithmetic operation relative to the crosstalk, there are required both the preceding data and the succeeding data in the time series.

For this reason, delay circuits shown in FIG. 13 are employed for adjusting the timing of the three-system input signals. In this manner, the signals supplied to three signal electrodes are processed with relative delays so that the phases of the three-system signals are mutually matched, and then the corrective calculator 42 performs a predetermined crosstalk corrective arithmetic operation. In the corrective calculator 42, the voltage difference between the adjacent signal electrodes is emphasized. A specific circuit configuration is achieved by the use of a memory, a digital signal processor or an operational amplifier similarly to the data/voltage converters 41R, 41G and 41B.

According to the present invention, as described hereinabove, any crosstalk or data diffusion caused between adjacent pixels due to the thickness of the dielectric sheet can be canceled by first processing picture signals through a corrective arithmetic operation and then supplying the processed signals to the display driving circuit. Consequently, it becomes possible to eliminate the known drawbacks peculiar to a plasma addressed display panel, such as deterioration of the color reproducibility and lowering of the resolution. In the correcting circuit, the picture-signal corrective arithmetic operation may be adaptively adjusted in accordance with the luminance or the color saturation of the displayed picture to thereby maintain constant the amplitude of the picture signal. Since the driving amplitude is kept constant, there is an advantage of preventing an increase in the power consumption and a rise in the production cost of the driving circuit. Furthermore, any crosstalk other than the relevant writing crosstalk is not increased either. Therefore it is possible to enhance the color reproducibility and the resolution without bringing about any other harmful side effect. In addition to the above, the correcting circuit may be so formed as to execute its corrective arithmetic operation after conversion of the primary picture signal, which has been input from an external source, into a secondary picture signal in accordance with the nonlinearity of the electro-optical characteristic of the display cell. In such a modification, the precision of the corrective arithmetic operation can further be enhanced.

Although the present invention has been described hereinabove with reference to some preferred embodiments thereof, it is to be understood that the invention is not limited to such embodiments alone, and a variety of other modifications and variations will be apparent to those skilled in the art without departing from the spirit of the invention.

The scope of the invention, therefore, is to be determined solely by the appended claims.

What is claimed is:

1. A display device comprising:

a display panel having a display cell with a plurality of signal electrodes arrayed in columns, a plasma cell with discharge channels arrayed in rows, and a dielectric sheet interposed between said display cell and said plasma cell;

a plasma driving circuit for sequentially driving said discharge channels to address said display cell;

a correcting circuit for processing pixel signals through a corrective arithmetic operation to generate adjusted pixel signals, said corrective arithmetic operation comprising separate individual adjustment of the signal for each pixel depending on signal values of signals for pixels adjacent thereto, said correcting circuit taking into account crosstalk originating in the dielectric sheet to minimize such crosstalk, said correcting circuit emphasizing differences between pixel signal values for adjacent pixels by expanding the differences in generating the adjusted pixel signals; and a display driving circuit for supplying the adjusted pixel signals, which have been processed by said correcting circuit to said signal electrodes.

2. The display device according to claim 1, wherein said corrective arithmetic operation is based on a difference between the values of pixel signals supplied to mutually adjacent signal electrodes.

3. The display device according to claim 2, wherein said correcting circuit adaptively adjusts the picture signal corrective arithmetic operation in accordance with the luminance and the color saturation of the displayed picture to thereby maintain constant the amplitude of the picture signals.

4. The display device according to claim 1, wherein said correcting circuit executes a corrective arithmetic operation on the pixel signals supplied to three mutually adjacent signal electrodes to which three primary colors are allocated respectively.

5. The display device according to claim 4, wherein said correcting circuit executes said corrective arithmetic operation after evaluating the pixel signals, which are to be supplied to said three signal electrodes, through relative delay to match phases of the picture signals.

6. The display device according to claim 5, wherein said plasma driving circuit determines the potential of each discharge channel, and said correcting circuit controls said voltage generating circuit in such a manner as to optimize the inversion reference voltage in accordance with the adjustment of the corrective arithmetic operation.

7. The display device according to claim 1, wherein said correcting circuit adaptively adjusts the corrective arithmetic operation in accordance with luminance and color saturation of a displayed picture to maintain constant the amplitude of the picture signals.

8. The display device according to claim 1, further comprising a voltage generating circuit to supply a predetermined inversion reference voltage to said plasma driving circuit.

9. The display device according to claim 8, wherein said plasma driving circuit prescribes a potential of each discharge channel, and said correcting circuit controls said voltage generating circuit in such a manner as to optimize the inversion reference voltage in accordance with adjustment based on the corrective arithmetic operation.

10. The display device according to claim 1, wherein said correcting circuit executes the corrective arithmetic operation after converting external input primary picture signals into secondary picture signals in accordance with a nonlinearity of the electro-optical characteristics of said display cell.

11. The display device according to claim 1, wherein said correcting circuit executes a process emphasizing the difference between the picture signals supplied to said mutually adjacent signal electrodes to thereby increase the amplitude of the picture signal.

12. The display device according to claim 1, further comprising a voltage generating circuit to supply a predetermined inversion reference voltage to said plasma driving circuit for changing the entire potentials in said plasma driving circuit.

13. The display device according to claim 1, wherein said correcting circuit executes said corrective arithmetic operation after converting external input primary picture signals into secondary picture signals in accordance with the nonlinearity of the electro-optical characteristics of said display cell.

14. A method of generating image information comprising the steps of:

providing a plurality of pixel signals for pixels arranged in a matrix;

individually adjusting each pixel signal based on values of pixel signals of pixels adjacent to the pixel whose pixel signal is being adjusted such that a same adjustment is not necessarily applied to each pixel signal for a given row or column of pixels, the adjustment taking into account crosstalk originating in a dielectric sheet disposed between a display cell and a plasma cell to minimize such crosstalk, the adjustment including emphasizing differences between pixel signal values for adjacent pixels by expanding the differences in generating adjusted pixel signals; and applying the so-adjusted pixel signals to their respective pixels.

15. A display device comprising:

a display panel having a laminated layered structure made up of a display cell with a plurality of signal electrodes arrayed in columns, a plasma cell with discharge channels arrayed in rows, and a dielectric sheet interposed between said display cell and said plasma cell;

a plasma driving circuit for sequentially driving said discharge channels to thereby address said display cell line-sequentially via said dielectric sheet;

a correcting circuit for processing original picture signals (Rd, Gd, Bd) through a corrective arithmetic operation to obtain corrected picture signals; and a display driving circuit for supplying the picture signals which have been processed by said correcting circuit to said signal electrodes in synchronism with the line-sequential addressing, and writing the picture signals in pixels arranged at the intersections of said signal electrodes and said discharge channels, characterized in that said original picture signals comprise each of respective original primary color picture signals (Rd, Gd, Bd), represented by corresponding primary color voltages, into corrected voltages based on a parameter ($\alpha$) ranging between 0 and ⅔ and a conversion defined by $$\begin{matrix} Ri \\ Gi \\ Bi \end{matrix} = D^{-1}(\alpha) \begin{matrix} Rd \\ Gd, \\ Bd \end{matrix}$$

wherein $$D^{-1}(\alpha) = \frac{1}{1-(2/3)(\alpha)} \begin{matrix} 1-\alpha/2 & -\alpha/2 & -\alpha/2 \\ -\alpha/2 & 1-\alpha/2 & -\alpha/2, \\ -\alpha/2 & -\alpha/2 & 1-\alpha/2 \end{matrix}$$

said corrected voltages each corresponding to respective corrected picture signals (Ri, Gi, Gi), said corrected picture signals thereafter being applied by the display driving circuit to three mutually adjacent signal electrodes of the display panel to which three primary colors are allocated.

* * * * *